United States Patent [19]

Foster et al.

[11] 4,418,622

[45] Dec. 6, 1983

[54] MUNROE EFFECT BREACHING DEVICE

[75] Inventors: John S. Foster, Fredericksburg; John A. M. Zehmer, III, Newport News, both of Va.

[73] Assignee: The United States of America as represented by the Secretary of the Navy, Washington, D.C.

[21] Appl. No.: 394,975

[22] Filed: Jul. 2, 1982

[51] Int. Cl.[3] ..... F42B 1/02

[52] U.S. Cl. ..... 102/307; 102/309; 102/331; 102/332; 102/289

[58] Field of Search ..... 102/306–310, 102/289, 331, 332

[56] References Cited

U.S. PATENT DOCUMENTS

| | | | |
|---|---|---|---|
| 2,977,885 | 4/1961 | Perry, Jr. et al. | 102/289 X |
| 3,035,950 | 5/1962 | Long | 102/289 X |
| 3,185,089 | 5/1965 | Parkhurst et al. | 102/24 |
| 3,499,283 | 3/1970 | Simpkins | 102/289 X |
| 3,658,006 | 10/1972 | Nistler et al. | 102/24 |
| 3,959,041 | 5/1976 | Knapp | 102/289 X |
| 4,043,266 | 8/1977 | Held | 102/306 |

FOREIGN PATENT DOCUMENTS

| | | | |
|---|---|---|---|
| 227775 | 8/1959 | Australia | 102/289 |

*Primary Examiner*—Peter A. Nelson

*Attorney, Agent, or Firm*—R. F. Beers; K. E. Walden; W. R. Henderson

[57] ABSTRACT

An unlined Munroe Effect device for breaching structures in urban terrain. The device is constructed as an unlined, linear, shaped explosive charge which directs an explosive jet into the structure. The shaped charge is formed with a honeycombed substrate of metal in which the substrate interstices are filled with and the substrate is covered by an explosive material. The substrate is embedded in the explosive material. The explosive material and substrate, prior to curing of the explosive material, are formed into an unlined, semi-cylindrical shape to create the explosive jet or Munroe Effect. The device is initiated or detonated with a booster charge.

10 Claims, 3 Drawing Figures

MUNROE EFFECT BREACHING DEVICE

BACKGROUND OF THE INVENTION

The present invention relates to a Munroe Effect device for breaching structures in urban terrain and more particularly to an unlined, linear, shaped explosive charge for directing an explosive jet into a wall or other urban structure.

During infantry combat in urban terrain, or during emergency operations of various types such as police, firefighting or personnel rescue, it is frequently necessary to gain immediate access to the inside of a structure such as a building. Devices for facilitating access to a building while minimizing hazards to operating personnel are typified by the device disclosed in U.S. Pat. No. 3,658,006 to Nistler et al. The patent to Nistler et al. discloses an explosively actuated egress and ingress device having a lined, linear, shaped explosive charge positioned within a case. The shaped explosive charge of Nistler et al. is lined with lead to form the explosive jet. The device of Nistler et al. fails to teach an unlined, linear, shaped explosive charge formed with a honeycombed substrate filled and covered with explosive material as disclosed in the present invention.

Another type of lined, linear, shaped charge is disclosed in U.S. Pat. No. 3,185,089 to Parkhurst et al. The patent to Parkhurst et al. teaches a flexible, linear, shaped charge for underwater applications. FIG. 14 of Parkhurst et al. discloses that the liner for the shaped charge may be formed of round or polygon shaped wires interwoven transversely and longitudinally. The device of Parkhurst et al. fails to teach an unlined, linear, shaped explosive charge formed with a honeycombed substrate filled and covered with explosive material as disclosed in the present invention.

SUMMARY OF THE INVENTION

Accordingly, there is provided in the present invention an unlined, Munroe Effect device for breaching structures in urban terrain during combat or emergency operations.

The device is constructed as an unlined, linear, shaped explosive charge which upon detonation directs an explosive jet into the wall or other structure. The shaped charge is formed with a honeycombed substrate of metal in which the interstices of the substrate are filled with and the substrate is covered by the explosive material such that the honeycombed substrate is embedded in the explosive material. The honeycombed substrate can be aluminum while the explosive material can be any suitable explosive material such as plastic bonded, castable, or curable explosive having urethane-like characteristics.

The explosive material and substrate, prior to curing of the explosive material, are formed into a semi-cylindrical or equivalent shape so as to create a cavity which directs an explosive jet into the wall or other structure. The unlined, linear, shaped explosive charge can be initiated by a booster charge detonated by explosive cord.

OBJECTS OF THE INVENTION

It is an object of the present invention to provide a Munroe Effect device for breaching structures in urban terrain.

Another object of the present invention is to provide an unlined, linear, shaped explosive charge for directing an explosive jet into an urban structure.

Another object of the present invention is to provide a shaped charge device which can be assembled by personnel in the field.

A further object of the present invention is to provide a Munroe Effect device which is simple to construct and operate.

A still further object of the present invention is to provide a Munroe Effect device which makes more efficient and economical use of explosive material.

A still further object of the present invention is to provide a shaped charge which has enhanced blast effects with a reduced amount of explosive material.

Other objects, advantages, and novel features of the present invention will become apparent from the following detailed description of the invention when considered in conjunction with the drawings.

BRIEF DESCRIPTION OF THE DRAWINGS

A more complete appreciation of the invention and many of the attendant advantages thereof will be readily understood by reference to the following detailed description when considered with the accompanying drawings in which like reference numerals designate like parts throughout the figures and wherein.

DESCRIPTION OF THE PREFERRED EMBODIMENT

Figure 1:
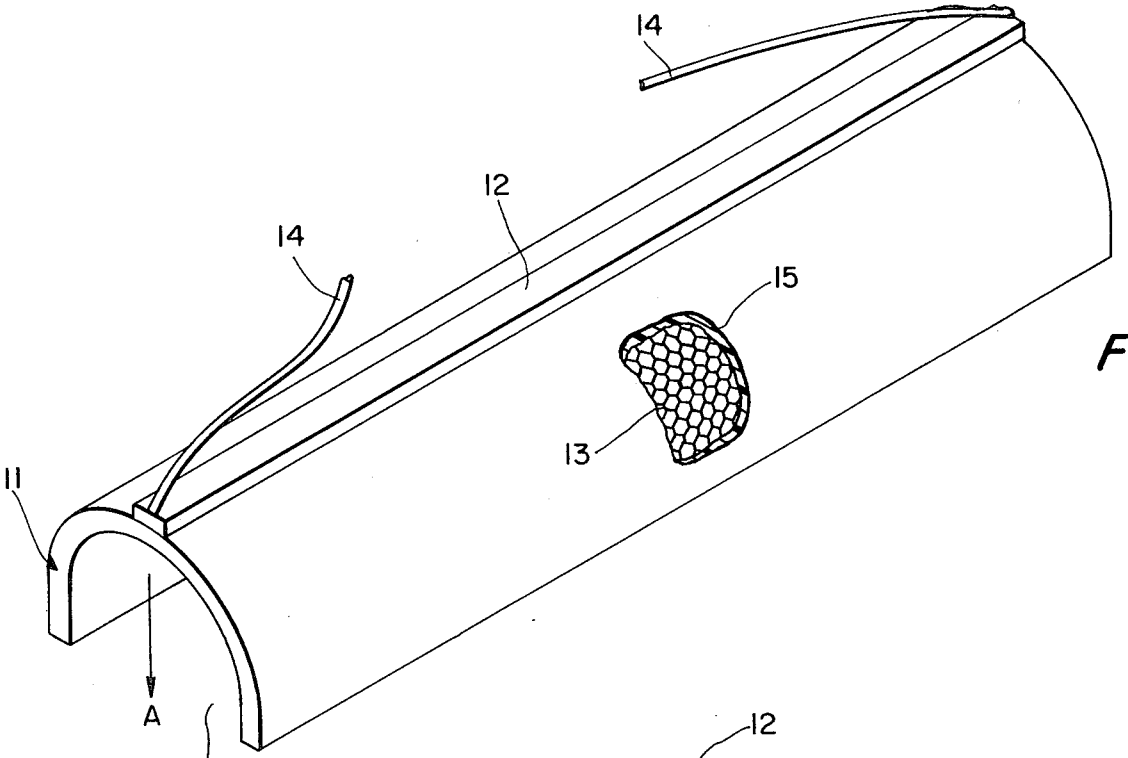
FIG. 1 illustrates an isometric view of the Munroe Effect device of the present invention.

Referring to FIG. 1 there is illustrated a Munroe Effect device 10 for breaching structures such as walls commonly found in urban terrain. A Munroe Effect device utilizes an explosive shock wave to produce a high velocity jet of molten metal having extremely large cutting pressures. The jet is produced by melting a metallic liner forming the base of the explosive and which collapses when the detonation wave reachs it. Device 10 is constructed having a linear, semicylindrical body 11 so as to create a shaped charge having cavity 17 for forming an explosive jet for penetrating the urban structure.

Figure 2:
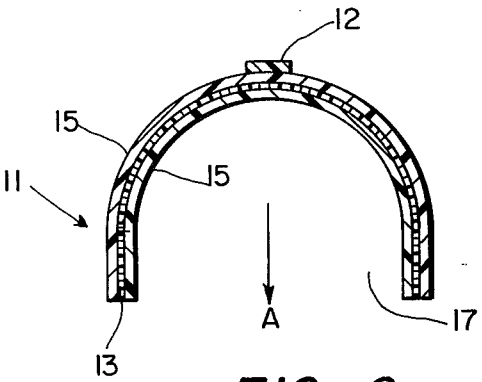
FIG. 2 illustrates in cross section the Munroe Effect device of the present invention.
Figure 3:
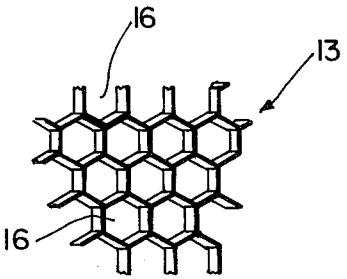
FIG. 3 illustrates the honeycombed substrate of the Munroe Effect device of the present invention.

As partially illustrated in the cutaway portion of FIG. 1, and better illustrated in the cross sectional view of FIG. 2, body 11 is constructed with a honeycombed substrate 13 which acts as a support for explosive material 15 which fills interstices 16 of honeycombed substrate 13 and also covers the substrate so as to embed the substrate within explosive material 15. Substrate 13, illustrated in FIG. 3, is formed into a shaped charge, here illustrated as being semi-cylindrical in shape. It is to be understood that substrate 13 can be formed into any equivalent shape which will create an explosive jet or Munroe Effect directed towards the wall or other urban structure.

Substrate 13 may be constructed of a suitable honeycombed metal such as aluminum, zirconium, magnesium or other equivalent reactive metal. Explosive material 15 is contemplated as being any suitable explosive material such as plastic bonded explosive, castable explosive, or curable explosive, having the physical characteristics of urethane which allows the explosive material to be applied in interstices 16 and cover substrate 13.

Device 10 is constructed by shaping substrate 13 into the desired shape and filling the interstices of substrate 13 with explosive material 15 in a plastic or moldable state and also covering the substrate with explosive material 15. Explosive material 15 then cures to form the device 10 which may be positioned on the structure to be breached with any known field adhesive (not shown) or other attachment means.

Referring again to FIG. 1, it can be seen that Munroe Effect device 10 is provided with a booster charge 12 and detonating cord 14 for further initiating device 10. Booster charge 12 may be any well known explosive material suitable for use as a booster charge while detonating cord 14 may be NONEL cord with a booster cap or TLX cord which may be initiated by an M16 flash arrester.

Referring to FIG. 2 there is illustrated in cross section, the Munroe Effect device 10 of the present invention. FIG. 2 illustrates the honeycombed substrate 13 surrounded by explosive material 15 so as to create an unlined, linear, shaped explosive charge which creates and directs an explosive jet in the direction illustrated by the arrow A of FIG. 2.

It is thus apparent that the disclosed Munroe Effect device for breaching walls or other structures in urban terrain provides for more efficient and economical use of explosive material. The shaped charge device of the present invention provides for enhanced blast effect and an aluminized explosive effect with a reduced amount of explosive material.

Many of these modifications and embodiments of the present invention, other than those set forth above, will readily come to mind to one skilled in the art having the benefit of the teachings presented in the foregoing description and accompanying drawings of the subject invention and hence it is to be understood that such modifications are included within the scope of the appended claims.

What is claimed as new and desired to be secured by Letters Patent of the United States is:

1. A Munroe Effect device for breaching walls in urban terrain, comprising:

a metallic, honeycombed support structure formed to have concavo-convex surfaces over a linear extent; and an explosive material completely covering said metallic, honeycombed support structure and filling the interstices thereof to define an unlined shaped charge;

whereby, upon detonation of said explosive material, the detonation wave melts said metallic, honeycombed support structure to produce a high velocity jet of molten metal directed outwardly from the concave surface for breaching walls in urban terrain.

2. The device of claim 1 further comprising:

means for detonating said explosive material.

3. The device of claim 1 wherein:

said metallic, honeycombed support structure is semicylindrical in shape.

4. The device of claim 1 wherein:

said metallic, honeycombed support structure is constructed of aluminum.

5. The device of claim 1 wherein:

said metallic, honeycombed support structure is constructed of a reactive metal.

6. the device of claim 1 wherein:

said metallic, honeycombed support structure is constructed of magnesium.

7. The device of claim 1 wherein:

said metallic, honeycombed support structure is constructed of zirconium.

8. The device of claim 1 wherein:

said explosive material is a plastic bonded explosive.

9. The device of claim 1 wherein:

said explosive material is a castable explosive.

10. The device of claim 1 wherein:

said explosive material is a curable explosive.

* * * * *